US008061642B2

(12) United States Patent
Chang

(10) Patent No.: US 8,061,642 B2
(45) Date of Patent: Nov. 22, 2011

(54) CUTTER DEVICE FOR A CRUSHING MACHINE

(76) Inventor: Yu-Chun Chang, Fongyuan (TW)

( * ) Notice: Subject to any disclaimer, the term of this patent is extended or adjusted under 35 U.S.C. 154(b) by 0 days.

(21) Appl. No.: 12/631,937

(22) Filed: Dec. 7, 2009

(65) Prior Publication Data

US 2010/0084498 A1 Apr. 8, 2010

Related U.S. Application Data

(63) Continuation-in-part of application No. 11/768,285, filed on Jun. 26, 2007, now abandoned.

(51) Int. Cl.
*B02C 18/16* (2006.01)

(52) U.S. Cl. ..... 241/294; 241/195; 241/189.1

(58) Field of Classification Search ..... 241/194, 241/195, 242, 189.1, 294
See application file for complete search history.

(56) References Cited

U.S. PATENT DOCUMENTS

| | | | | |
|---|---|---|---|---|
| 6,837,453 | B2 * | 1/2005 | Sturm | 241/243 |
| 6,880,774 | B2 * | 4/2005 | Bardos et al. | 241/189.1 |
| 7,004,413 | B2 * | 2/2006 | Langlois | 241/242 |
| 7,055,770 | B2 * | 6/2006 | Bardos | 241/189.1 |
| 2001/0040198 | A1 * | 11/2001 | Rossler | 241/294 |
| 2002/0125353 | A1 * | 9/2002 | Bardos et al. | 241/30 |
| 2005/0116074 | A1 * | 6/2005 | Kusak | 241/195 |

* cited by examiner

*Primary Examiner* — Faye Francis
(74) *Attorney, Agent, or Firm* — Ming Chow; Sinorica, LLC

(57) ABSTRACT

A cutter device for a crushing machine includes a rotary cutter base body and plural cutters. The rotary cutter base body is formed integral and has an outer peripheral side axially and equidistantly formed with plural annular ribs respectively provided with plural flat cut surfaces. Each flat cut surface is formed integral with a protruding fixing base with a fixing hole for locking each cutter on the fixing base. Each cutter body is formed with a cutting side disposed with at least four arcuate cutting edges extending toward the center to form a bulging portion, with the cross section of the cutter side formed with a double-curved surface for thickening the cutter to prolong its service life. The fixing bases are formed integrally with the rotary cutter base body to increase their strength.

6 Claims, 9 Drawing Sheets

CUTTER DEVICE FOR A CRUSHING MACHINE

RELATED APPLICATION

The present application is a continuation-in-part application and claims benefits of a U.S. patent application Ser. No. 11/768,285 filed on Jun. 26, 2007, now abandoned.

BACKGROUND OF THE INVENTION

1. Field of the Invention

This invention relates to a cutter device for a crushing machine and particularly relates to a cutter device formed integrally and employed for crushing wood chips or plastic material. The invention is a continuation-in-part application of the U.S. patent application Ser. No. 11/768,285.

2. Description of the Prior Art

The cutter device of a conventional crushing machine, as shown in FIGS. 1, 2 and 3, includes a cutter base body 10 and a plurality of cutters 20. The cutter base body 10 consists of a plurality of rollers 11 arranged successively. The peripheral sides of the plurality of rollers 11 are respectively and diametrically formed with axially successive arch ribs 12. Each arch rib 12 has a triangular cross section and is formed with at least one recess 121 to be filled up with filler for welding and fixing a cutter base 13 thereon. Further, the welding location at the recess 121 of each rib 12 of the cutter base 13 and the roller 11 is formed with plural sintered dots 14. The topside of each cutter body 20 is provided with four cutting edges 21 respectively formed with an arcuate edge recessed downward and the cutters 20 are respectively bored with a combining hole 22 for securing the cutter body 20 on the cutter base 13 to enable the cutters 20 to be disassembled and replaced with convenience. However, when the cutter bases 13 of the conventional crushing machine are to be installed, each cutter base 13 has to be accurately aligned to the recess 121 and then secured with the filler in the recess 121 by welding. Thus, when the cutter bases 13 are welded, the rollers 11 of the cutter base body 10 are easily deformed due to heat produced by welding, likely to result in inaccuracy when the cutter base body 10 is to be assembled later on. In addition, when used, the crushing machine may be broken apart from the sintered dots 14 if the sintered dots 14 are not made with high welding technique.

SUMMARY OF THE INVENTION

The objective of this invention is to offer a cutter device for a crushing machine, which includes a rotary cutter base and a plurality of cutters. The rotary cutter base has outer peripheral surface axially and equidistantly formed with a plurality of annular ribs axially and respectively provided with plural flat cut surfaces along the rotary cutter base. Each flat cut surface is disposed with a protruding fixing base with a fixing hole for locking each cutter on the fixing base. Each cutter body is formed with a cutting side and a back, and the cutting side is provided with at least four arcuate cutting edges respectively extending toward the center to form a bulging portion, letting the cross section of the cutting side formed with a double-curved surface. The cutter back is bored with a combining hole, and a locking member is to be inserted through the fixing hole of the fixing base from another sidewall of the rotary cutter base and then secured in the combining hole of the cutter back.

The rotary cutter base and the fixing bases in the present invention are formed integral so they can be shaped with great precision and impossible to be deformed, thus saving time in manufacturing and facilitating the cutters to be locked on the fixing bases. Further, each cutter has four cutting edges extending toward the center to form a bulging portion for thickening the cutter, thus able to prolong their service life and lower equipment cost. Furthermore, the annular ribs are respectively formed with arcuate cross sections and the flat cut surfaces are respectively provided with a first flat cut portion and a second flat cut portion, all helpful to carry quantities of wood chips. Moreover, the cross section of each cutting side is formed with a double-curved surface for facilitating wood chips to be cast out and speeding up chip cutting work, and the fixing bases are respectively formed integrally on the flat cut surface of the annular rib.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
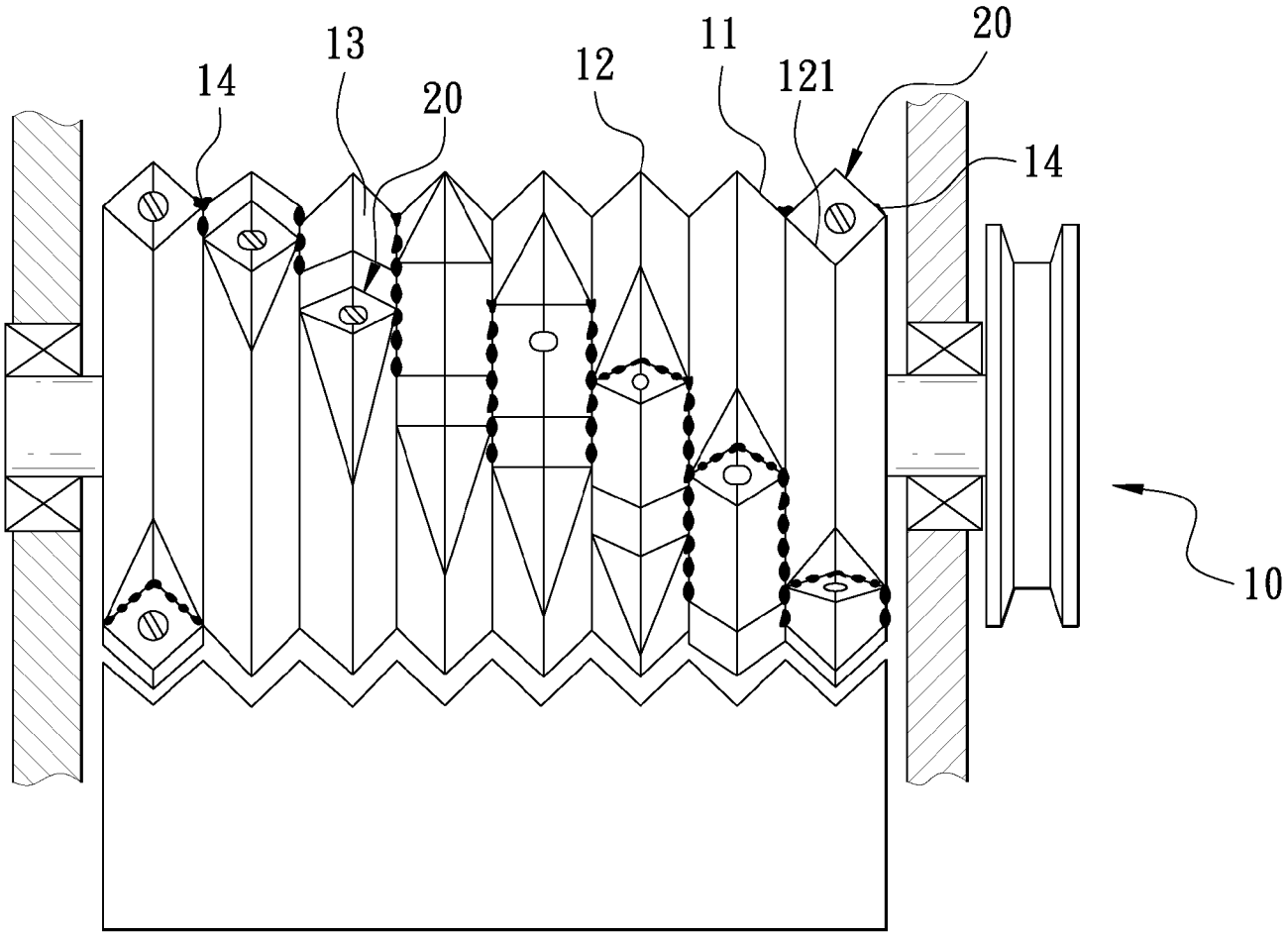
FIG. 1 PRIOR ART
FIG. 1 is a cross-sectional view of the cutter device of a conventional crushing machine.
Figure 2:
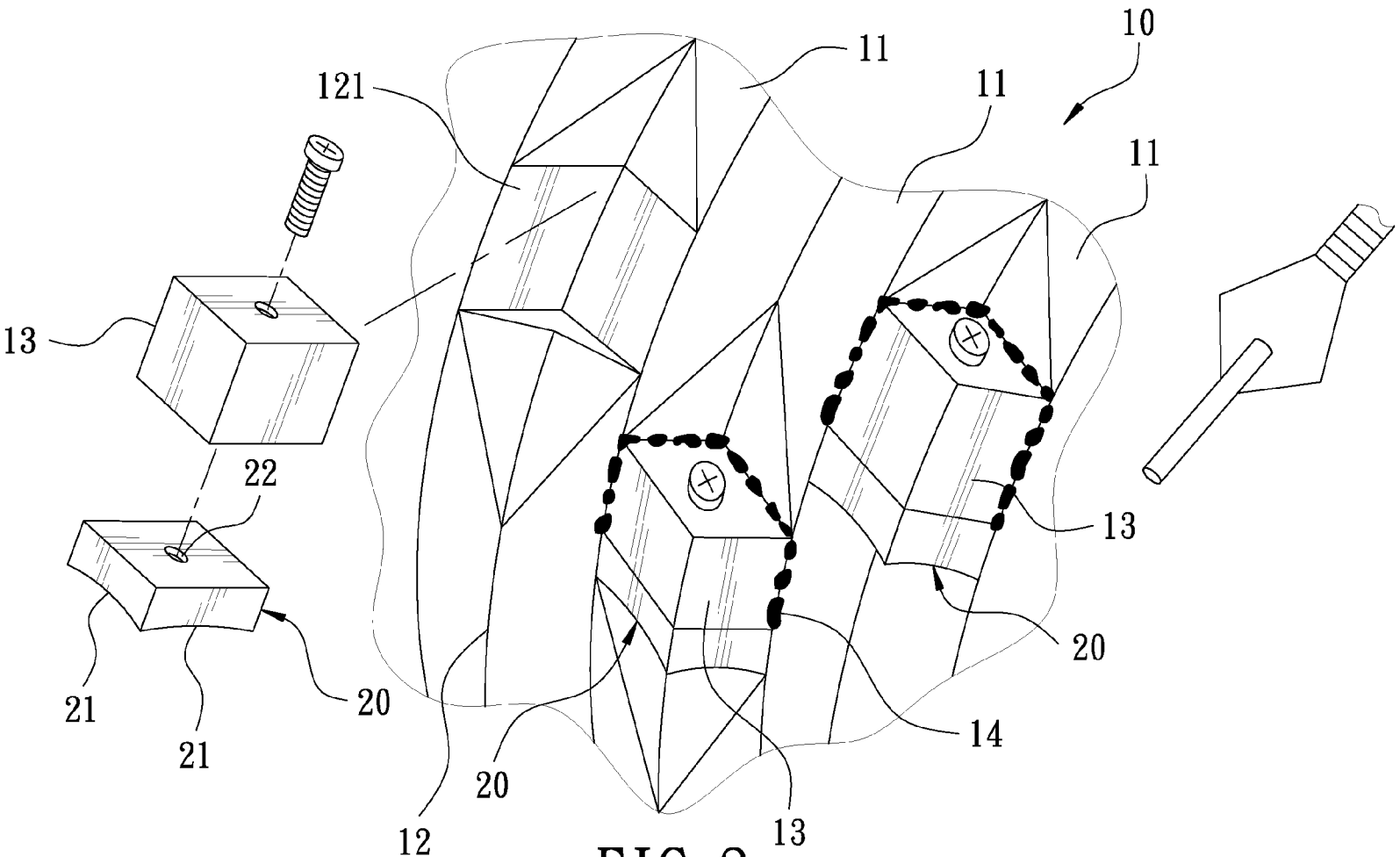
FIG. 2 PRIOR ART
FIG. 2 is an exploded perspective view of the cutters of the conventional crushing machine.
Figure 3:
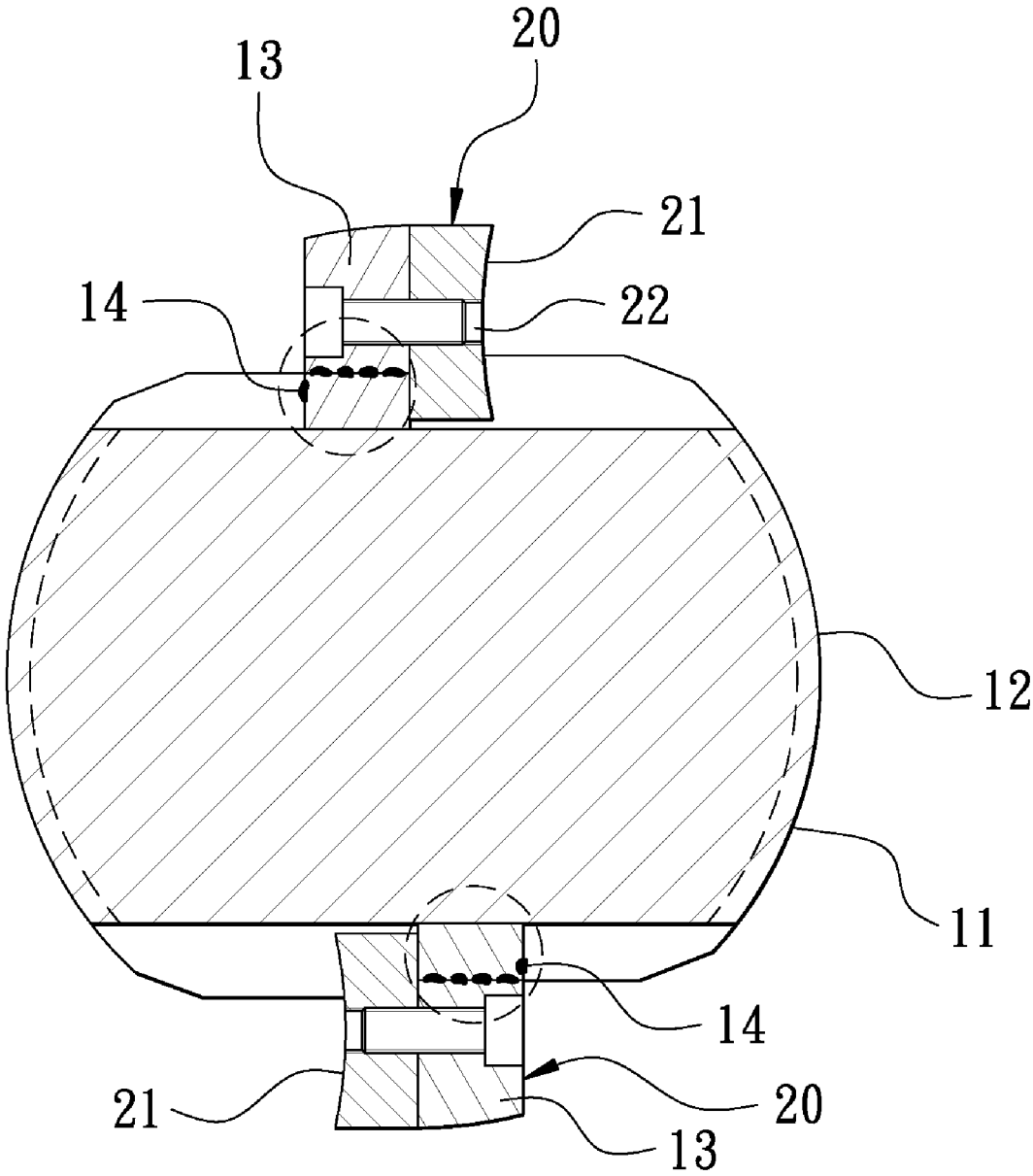
FIG. 3 PRIOR ART
FIG. 3 is a perspective view of the cutters of the conventional crushing machine.
Figure 4:
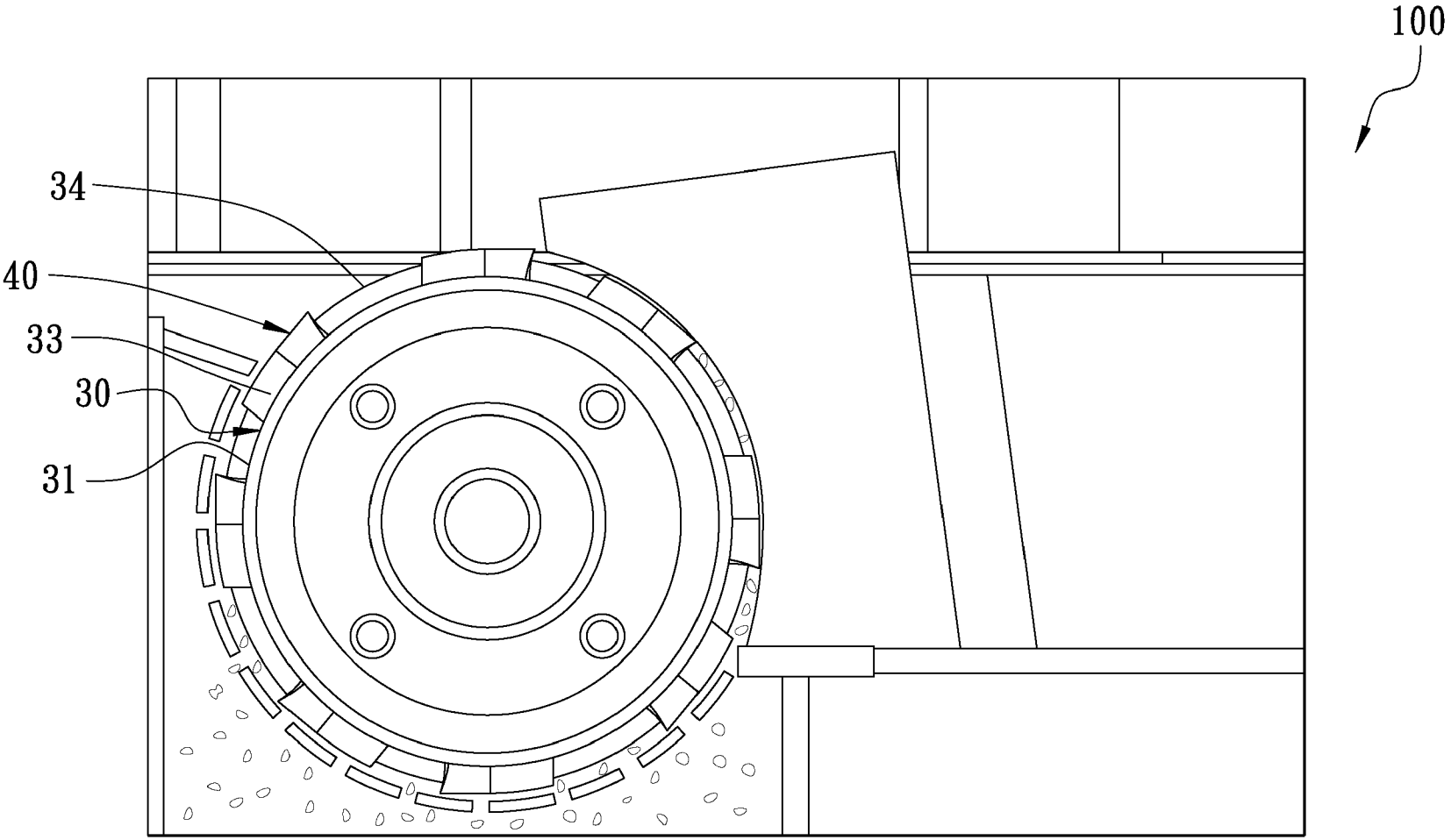
FIG. 4 is a front view of the preferred embodiment of a crushing machine in the present invention.

A preferred embodiment of a cutter device for a crushing machine 100 in the present invention, as shown in FIG. 4, is installed in the interior of the crushing machine 100 for crushing timber conveyed by a conveyer device and includes a rotary cutter base body 30 and a plurality of cutters 40 combined together.

Figure 5:
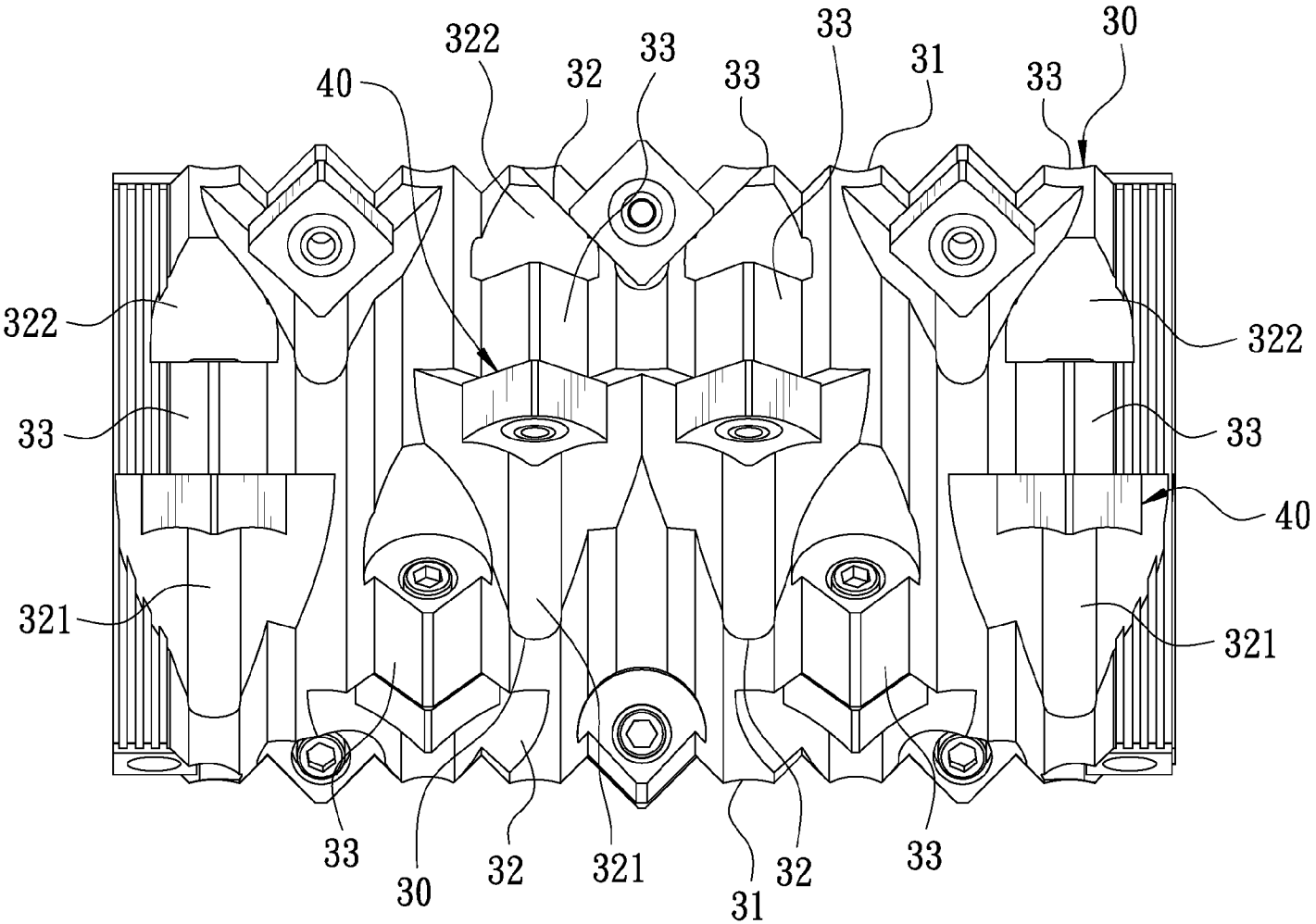
FIG. 5 is a side cross-sectional view of a cutter device of the crushing machine in the present invention.
Figure 6:
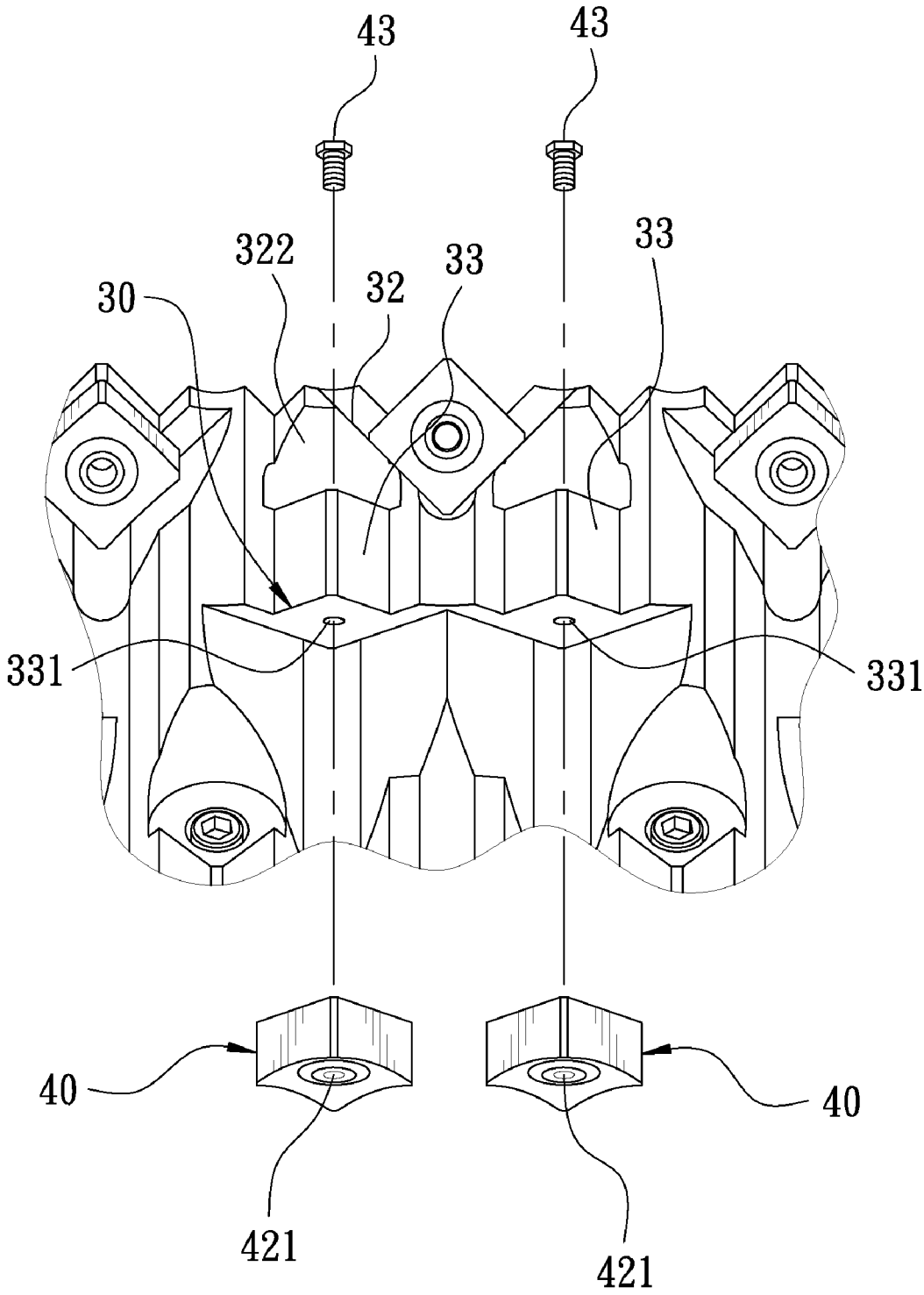
FIG. 6 is an axially cross-sectional view of cutters of the crushing machine in the present invention.
Figure 7:
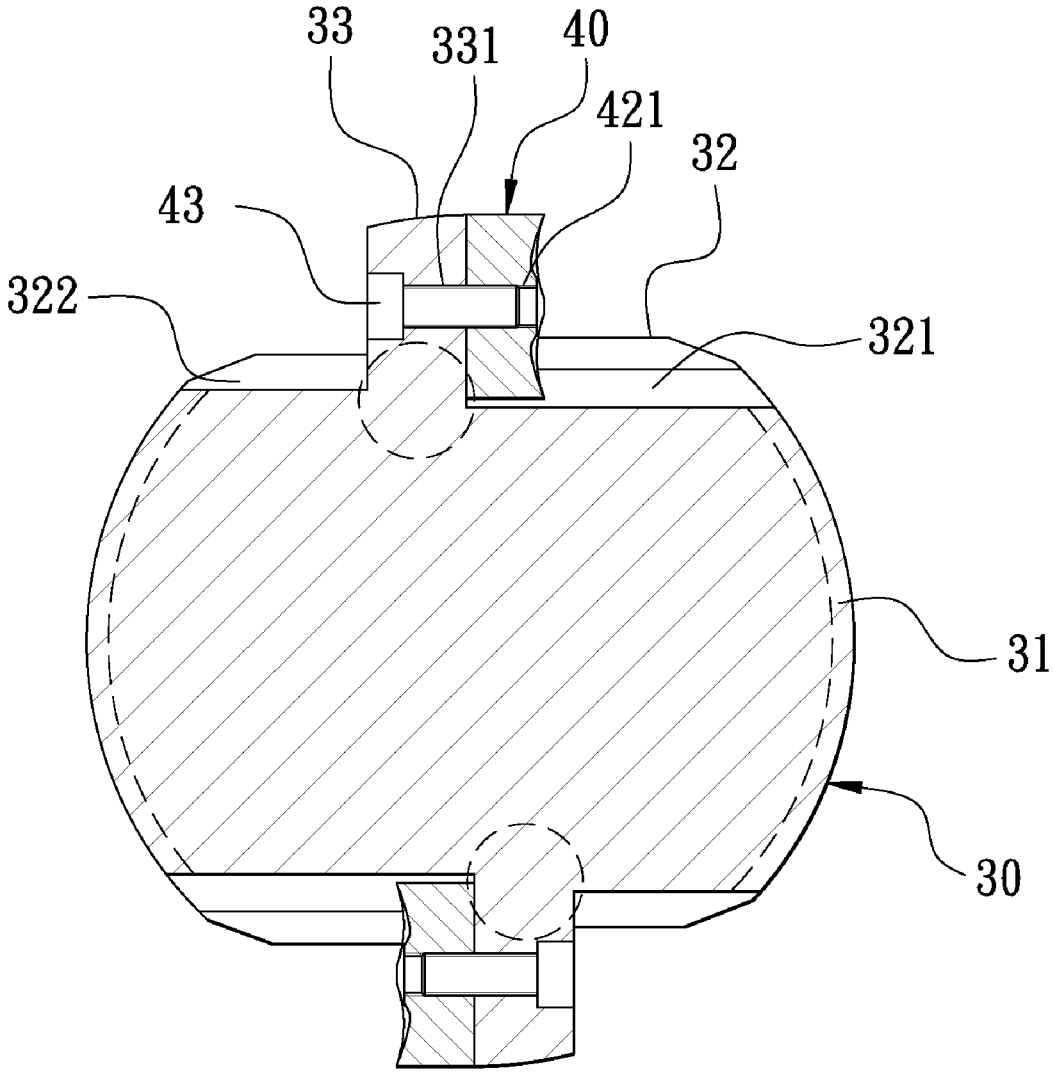
FIG. 7 is a diametrically cross-sectional view of the cutter device of the crushing machine in the present invention.
Figure 8:
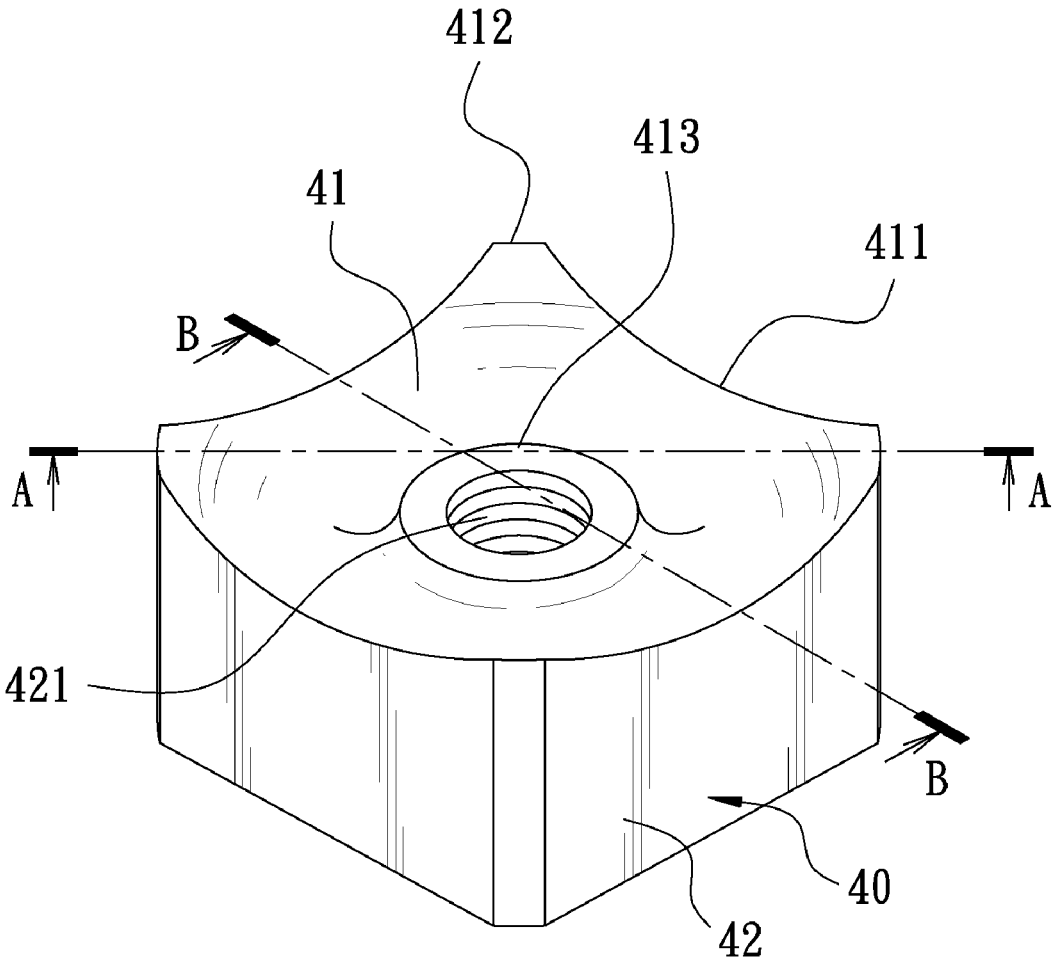
FIG. 8 is a perspective view of each cutter of the crushing machine in the present invention.

The rotary cutter base body 30, referring to FIGS. 5, 6 and 7, is formed integral and able to be rotated axially. The rotary cutter base body 30 has an outer peripheral surface axially and equidistantly formed with a plurality of annular ribs 31 respectively and diametrically provided with plural flat cut surfaces 32 along the rotary cutter base body 30, and each flat cut surface 32 is divided into a first flat cut portion 321 and a second cut portion 322 and disposed with a fixing base 33 with a fixing hole 331 and, with the fixing base 33 serving as boundary and provided with a fixing hole 331. The annular rib 31 is generally formed with an M-shaped arcuate cross-section, and the fixing bases 33 of the annular ribs 31 can be distributed in stagger, in parallel or in non-parallel. Said flat cut surface is extended adjacent to said annular rib. The preferred embodiment of the fixing bases 33 in the present invention are distributed in stagger.

Figure 9:
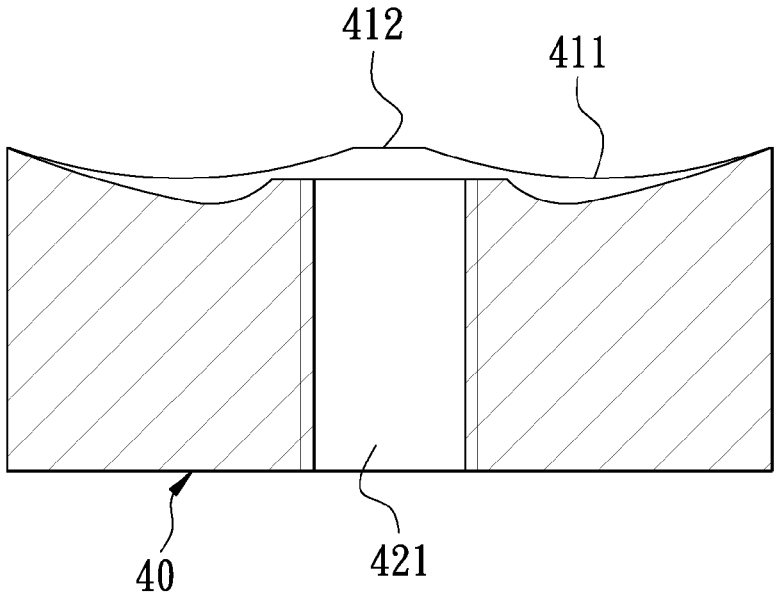
FIG. 9 is a cross-sectional view of the line A-A in FIG. 8.
Figure 10:
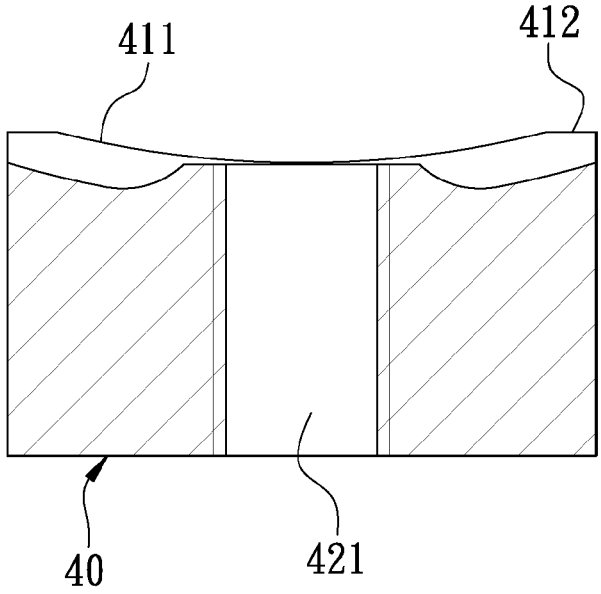
FIG. 10 is a cross-sectional view of the line B-B in FIG. 8.

The cutters 40 are respectively assembled on one sidewall of the fixing base 33, as shown in FIGS. 7 to 10, respectively formed with a cutting side 41 and a cutter back 42. The cutting side 41 of each cutter 40 is provided with at least four arc-shaped blade edges 411 having their corners respectively formed with a chamfering angle 412, and the four blade edges 411 are respectively extended toward the center of each cutter 40 to form a bulging portion 413, with the cross section of the cutting side 41 formed with a double-curved surface, as shown in FIGS. 9 and 10. The cutter back 42 of each cutter 40 is bored with a combining hole 421 so that the rotary cutter base body 30 can use a locking member 43 to be inserted through the fixing hole 331 of the fixing base 33 and firmly locked in the combining hole 421 of the cutter body 40.

To further understand the features of the structure, technological approaches and expected efficiency of the invention, how to use it is to be described below.

Referring to FIG. 6, the rotary cutter base body 30 is formed integral and has peripheral surface axially and equidistantly formed with annular ribs 31 respectively having an M-shaped arcuate cross-section, and the annular ribs 31 are respectively and diametrically provided with the flat cut surfaces 32 along the rotary cutter base body 30. The flat cut surfaces 32 are respectively provided thereon with a protruding fixing base 33 that is formed integrally with the rotary cutter base body 30 so the fixing base 33 will never be deformed, and the flat cut surfaces 32 and the opposite sides of the fixing base 33 are reserved with the first flat cut portion 321 and the second flat cut portion 322. In assembling, the locking member 43 is diametrically inserted through the fixing hole 331 from the rear sidewall of the fixing base 33 and then firmly locked in the combining hole 421 of the cutter back 42 to lock the cutter 40 between the fixing base 33 and the flat cut surface 32, thus finishing assembly of the cutter device. In using and operating, referring to FIG. 4, when the crushing machine 100 is started to drive the rotary cutter base body 30 to rotate, the cutters 40 distributed unevenly on the rotary cutter base body 30 will be actuated to rotate along the diametrical periphery of the rotary cutter base body 30 and cut quantities of wood chips that are carried by the annular ribs 31 and the first and the second flat cut portion 321, 322. Then, the crushed wood chips will quickly be conveyed to a chips-collecting box (not shown) to be collected therein.

As can be understood from the above description, this invention has the following advantages.

1. Each cutter has four cutting edges extending toward the center to form a bulging portion for thickening the cutter, able to prolong its service life, and the peripheries of the annular ribs are respectively formed into arcuate cross-sections, able to reduce equipment cost. In addition, the first flat cut portions and the second flat cut portions of the flat cut surfaces are helpful to carry quantities of wood chips, and the section of the cutting side of the cutter is formed with a double-curved surface for facilitating wood chips to be cast out, able to speed up chips collection and shorten hours of chip crushing work.

2. The fixing bases are formed integrally on the rotary cutter base body; therefore, the fixing bases can be produced with great precision and impossible to be deformed, thus saving time in manufacturing and facilitating the cutter to be secured on the fixing base.

While the preferred embodiment of the invention has been described above, it will be recognized and understood that various modifications may be made therein and the appended claims are intended to cover all such modifications that may fall within the spirit and scope of the invention.

I claim:

1. A cutter device for a crushing machine comprising:

a rotary cutter base body formed integral and able to be rotated axially, said rotary cutter base body having outer peripheral surface axially and equidistantly formed with a plurality of annular ribs, said annular ribs respectively and diametrically provided with plural flat cut surfaces along said rotary cutter base body, said flat cut surfaces respectively disposed with a protruding fixing base with a fixing hole, said flat cut surfaces formed with a first cut portion and a second cut portion, with said fixing base severing as a boundary;

a plurality of cutters each of which respectively installed on a sidewall of said fixing base, each said cutter formed with a cutting side and a cutter back, said cutting side provided with at least four arc-shaped blade edges extending toward a center of each said cutter to form a bulging portion, said cutting side having a cross section formed with a double-curved surface, said cutter back bored with a combining hole, a locking member inserted through said fixing hole from another sidewall of said fixing base and firmly locked in said combining hole of said cutter back.

2. The cutter device for a crushing machine as claimed in claim 1, wherein said fixing bases of each said annular rib on said rotary cutter base body are distributed in stagger.

3. The cutter device for a crushing machine as claimed in claim 1, wherein said fixing bases of each said annular rib on said rotary cutter base body are distributed in parallel.

4. The cutter device for a crushing machine as claimed in claim 1, wherein said fixing bases of each said annular rib on said rotary cutter base body are distributed in non-parallel.

5. The cutter device for a crushing machine as claimed in claim 1, wherein said annular rib is formed with an M-shaped arcuate cross-section.

6. The cutter device for a crushing machine as claimed in claim 1, wherein said flat cut surface is extended adjacent to said annular rib.

* * * * *